United States Patent [19]

Thomas

[11] Patent Number: 5,022,044

[45] Date of Patent: Jun. 4, 1991

[54] DIRECTLY HEATABLE CRUCIBLE FOR INDUCTION MELTING FURNACES

[75] Inventor: Friedrich-Werner Thomas, Gelnhausen, Fed. Rep. of Germany

[73] Assignee: Leybold Aktiengesellschaft, Hanau, Fed. Rep. of Germany

[21] Appl. No.: 391,125

[22] Filed: Aug. 9, 1989

[30] Foreign Application Priority Data

Feb. 16, 1989 [DE] Fed. Rep. of Germany ..... 3904607

[51] Int. Cl.[5] ..... H05B 6/22

[52] U.S. Cl. ..... 373/151; 373/156; 219/10.491

[58] Field of Search ..... 373/151, 152, 154, 158, 373/153, 155, 156, 157; 219/10.491

[56] References Cited

U.S. PATENT DOCUMENTS 1,707,294 3/1929 Woodson ..... 373/156
3,162,710 12/1964 Anderson ..... 13/27
3,383,840 5/1968 Johnson et al. ..... 55/293
3,935,412 1/1976 McDonough et al. ..... 219/10.491
4,738,713 4/1988 Stickle et al. ..... 75/10.18

FOREIGN PATENT DOCUMENTS 518499 1/1931 Fed. Rep. of Germany .
315944 10/1956 Switzerland .

*Primary Examiner*—Bruce A. Reynolds
*Assistant Examiner*—Tu Hoang
*Attorney, Agent, or Firm*—Felfe & Lynch

[57] ABSTRACT

In a directly heatable crucible 3 for induction melting furnaces, especially for melting refractory and highly-pure metals, including an inductor coil 11 surrounding a crucible 3 and a housing 5, which at least partially encloses the inductor coil 11 and the crucible 3 and which forms together with the external wall 9, 9' of the crucible a closed chamber having an annular portion 10 and a flat cylindrical base portion 10'. This chamber is passed through by a cooling agent and the crucible 3 is made of the material to be molten.

7 Claims, 1 Drawing Sheet

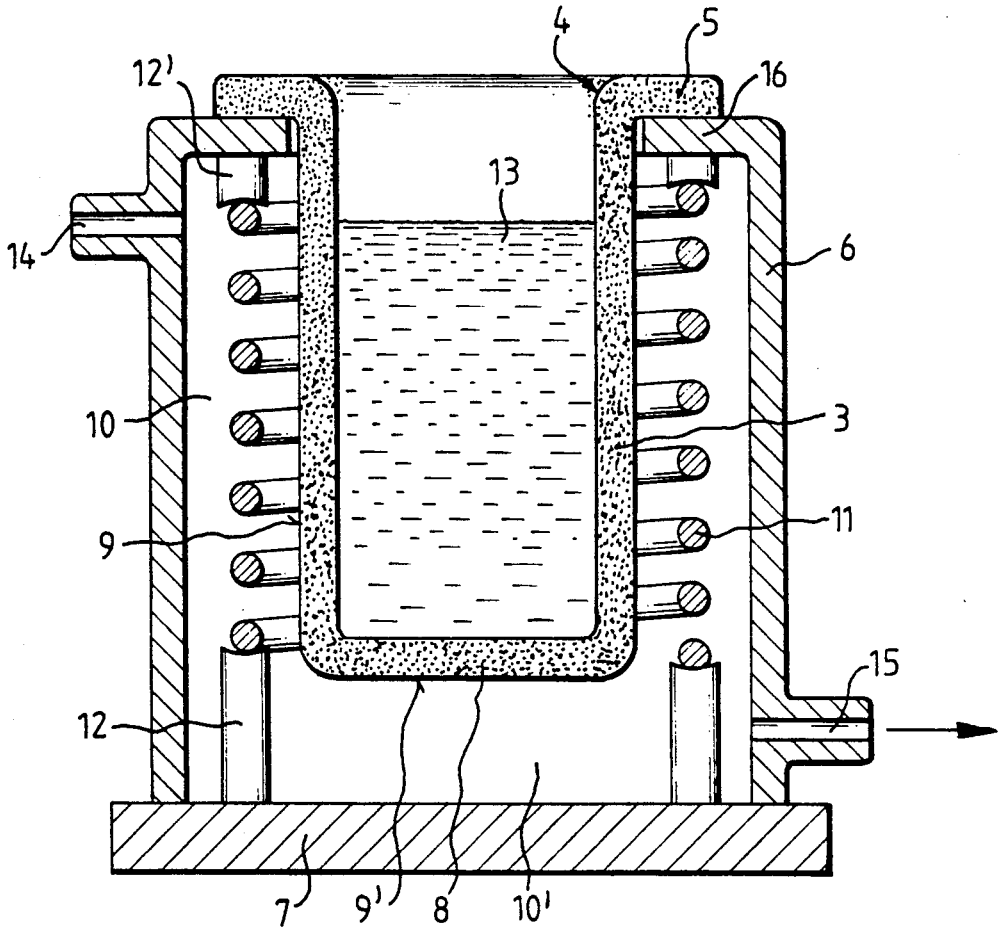
4
5
12'
16
13
14
6
10
3
9
11
15
12
7
9'
8
10'

DIRECTLY HEATABLE CRUCIBLE FOR INDUCTION MELTING FURNACES

BACKGROUND OF THE INVENTION

The invention relates to a directly heatable crucible for induction melting furnaces, particularly for melting refractory and highly-pure metals. An induction coil surrounds the crucible and a housing at least partially encloses the inductor coil and the crucible and forms a closed chamber together with the external wall of the crucible.

A process is known for melting refractory metals, particularly tantalum, tungsten, thorium or alloys of these metals in a water-cooled crucible (DE 518 499); the crucible is made of materials which have a lower melting point than the material to be molten, e.g. made of quartz glass, copper or silver. The energy required for the melting process as well as for the cooling of the crucible is supplied such that the material is completely molten without causing impurities by the crucible material.

Furthermore, a replaceable, pounded crucible is known for grooveless induction melting furnaces including a metallic, non-live, basket-like frame which surrounds the crucible or which is incorporated in the external wall thereof (CH 315 944). The frame is composed of water-cooled, flat or oval pipes made of a non-magnetic material.

Also known is an induction melting furnace including a replaceable crucible (U.S. Pat. No. 3,162,710) which has an insert made of refractory material and can be inserted into an external sleeve of sheet metal. This external sleeve is surrounded by an inductor coil which, at the same time, serves as a cooling element. The inductor coil, in turn, is supported by a rack which is configured as a hollow cylinder.

Further, a device for melting and casting titanium has been suggested (U.S. Pat. No. 3,383,840) wherein the crucible is a sleeve made of graphite which is surrounded by a pot-like jacket made of a relatively thin-walled ceramic material. The inductor coil which, in turn, encloses the graphite jacket is surrounded by a hood which rests on a base plate as does the crucible.

Finally, a device is known for melting reactive metals and metal alloys (EP 0 276 544), to which U.S. Pat. No. 4,738,713 corresponds wherein the crucible is made of stave-like metal rods which are provided with vertically running pocket holes in which end thin-walled pipes. These pipes are used to feed cooling water into the pocket holes. The metal rods which form narrow, vertically extending gaps between two adjacent rods are connected to one another as one piece via the base plate under which the feed lines are disposed for supplying the cooling agent to the thin-walled pipes.

These known induction melting furnaces have the particular disadvantage that a large portion of the electric energy which is necessary for the melting process is already lost in the crucible.

SUMMARY OF THE INVENTION

It is an object of the present invention to provide an induction melting furnace in which only a small portion of the electric energy necessary for the melting process is lost in the crucible, and which is suitable for obtaining a highly-pure melt.

The object is achieved in that a cooling agent passes through the chamber and in that the crucible is made of the material to be molten.

Preferably, the crucible is pot-like, of pure metal or a highly pure metal alloy and as one piece.

Advantageously, the housing which surrounds the external wall of the crucible forms together with the bottom part of the pot-like crucible an annular chamber portion and an approximately cylindrical, flat portion passed though by a cooling agent.

At its top circumferential rim, the approximately pot-like crucible advantageously has arms which radially extend toward the exterior or has a flange-like enlargement or an edge with which it rests or is supported on the top edge of the external housing; the housing itself is also pot-like, and the bottom part of the housing is supported spaced-apart from the bottom part of the crucible.

In order to ensure a cooling of the crucible and the inductor coil, the inductor coil is fixed in a certain distance to the crucible by means of a supporting frame which, in turn, is supported on the base plate and/or the housing flange and prevents the inductor coil from contacting the crucible or the housing.

BRIEF DESCRIPTION OF THE DRAWING

The sole FIGURE is a diagrammatic cross-section.

DETAILED DESCRIPTION OF THE PREFERRED EMBODIMENT

The crucible 3 has a pot-like shape and is made of the metal which is also to be melted, for example, pure titanium in case a pure titanium charge is to be molten. The top, circumferential rim 4 of the crucible 3 is provided with a flange-like edge 5 with which the latter rests on the top edge or the flange 16 of the circular cylindrical housing part 6. The housing part 6, in turn, is supported on a base plate 7 and rigidly attached thereto, by means of welding, for example. The housing part 6 and the base plate 7 collectively form the housing. The height of the housing part 6 is selected such that the bottom part 8 of the crucible 3 is supported in a spaced-apart relationship to the base plate 7. The housing and the crucible form a closed chamber having an annular portion 10 between the part 6 and the circumferential wall 9 of the crucible, and a flat cylindrical base portion 10' between the bottom part 8 of the crucible and the base plate 7.

The inductor coil 11 is disposed in the annular portion 10 of the chamber 10, 10' where it is supported by a special support frame 12, 12'. As it is commonly known, the crucible assumes during the melting process the function of a short-circuited secondary coil when transferring the voltage according to the transformer principle.

While the material 13 is molten, a liquid coolant agent is continuously pumped from the inlet 14 via chamber 10, 10' to the outlet 15. On the one hand, the inductor coil 11 is thus cooled and, on the other hand, the wall of the crucible 3 is protected from overheating, and the mechanical stability of the crucible 3 is ensured. This can even be further supported by correspondingly selecting the operational frequency. Due to the overlapping of inductive heating and simultaneous intensive cooling a stable crucible wall thickness is created in the area of the crucible wall 3 during this process. In this area the temperature drops from the melting point in the interior of the cooled crucible 3 to the temperature of the cooled crucible wall. It is significant that the melt is not contaminated since the crucible itself is made of a highly-pure material or of the same alloy as the material to be molten. Depending on the material to be molten, the entire device can be operated under atmospheric conditions or, if correspondingly configured, in a vacuum.

I claim:

1. An induction furnace for melting a material, comprising a crucible made of the material to be melted, a housing surrounding said crucible so that said housing and said crucible form a closed cooling chamber between said housing and said crucible, said housing having inlet means and outlet means for passing coolant through said chamber, and an induction coil surrounding said crucible in said chamber.

2. An induction furnace as in claim 1 wherein said crucible is configured as a single pot-like piece having a circumferential wall and a bottom part.

3. An induction furnace as in claim 2 wherein said cooling chamber comprises an annular portion and a flat cylindrical base portion.

4. An induction furnace as in claim 2 wherein said housing is also pot-like and comprises a circular cylindrical part and a base plate, said crucible comprising flange means extending radially outward from said circumferential wall to support said crucible on said circular cylindrical part of said housing.

5. An induction furnace as in claim 1 further comprising a support frame which fixes said induction coil in said chamber, said support frame being fixed to said housing.

6. An induction furnace as in claim 1 wherein said crucible is made of a single pure alloy.

7. A method of induction melting a material without introducing impurities therein, comprising providing an induction melting furnace having a crucible made of a single pure material, a housing surrounding said crucible so that said housing and said crucible form a closed chamber having inlet means and outlet means for a coolant, and an induction coil surrounding said crucible in said chamber, passing a coolant through said closed chamber, and melting in said crucible a material of the same pure material as said crucible.

* * * * *